US007722697B2

(12) United States Patent
Daxelmüller et al.

(10) Patent No.: US 7,722,697 B2
(45) Date of Patent: May 25, 2010

(54) SREADING KNIVES, DOCTOR BLADES AND CREPE SCRAPERS AND POWDER METALLURGICAL METHOD FOR PRODUCING THE SAME

(75) Inventors: Manfred Daxelmüller, Waidhofen/Ybbs (AT); Helmut Ponemayr, Allhartsberg (AT)

(73) Assignee: Böhler-Uddeholm Precision Strip GmbH & Co. KG, Bohlerwerk (AT)

( * ) Notice: Subject to any disclaimer, the term of this patent is extended or adjusted under 35 U.S.C. 154(b) by 485 days.

(21) Appl. No.: 11/572,381

(22) PCT Filed: Jul. 7, 2005

(86) PCT No.: PCT/EP2005/007356

§ 371 (c)(1),
(2), (4) Date: Jan. 19, 2007

(87) PCT Pub. No.: WO2006/007984

PCT Pub. Date: Jan. 26, 2006

(65) Prior Publication Data

US 2008/0096037 A1 Apr. 24, 2008

(30) Foreign Application Priority Data

Jul. 19, 2004 (DE) ..... 10 2004 034 905

(51) Int. Cl.

| | |
|---|---|
| ***C22C 33/02*** | (2006.01) |
| ***C22C 38/22*** | (2006.01) |
| ***C22C 38/24*** | (2006.01) |
| ***C21D 1/09*** | (2006.01) |
| ***C21D 7/02*** | (2006.01) |
| ***B22F 3/24*** | (2006.01) |

(52) U.S. Cl. ..... 75/246; 419/28; 419/29; 148/325; 148/333; 148/334; 148/651; 148/565

(58) Field of Classification Search ..... 419/28, 419/29; 75/246; 148/333–335, 663, 325, 148/651, 565

See application file for complete search history.

(56) References Cited

U.S. PATENT DOCUMENTS

| | | | | |
|---|---|---|---|---|
| 3,150,444 | A * | 9/1964 | Reen | 419/48 |
| 5,578,773 | A | 11/1996 | Wisell et al. | |
| 6,162,275 | A | 12/2000 | Jonsson et al. | |
| 6,423,427 | B1 * | 7/2002 | Mehmood | 428/682 |

FOREIGN PATENT DOCUMENTS

| | | |
|---|---|---|
| DE | 1533275 | 10/1975 |
| DE | 3815833 | 11/1989 |
| EP | 0672761 | 9/1995 |
| EP | 1382704 | 1/2004 |
| JP | 61/041749 | 2/1986 |
| JP | 2003-340345 | * 12/2003 |
| WO | 0235002 | 5/2002 |

* cited by examiner

*Primary Examiner*—Deborah Yee
(74) *Attorney, Agent, or Firm*—Renner, Otto, Boisselle & Sklar, LLP

(57) ABSTRACT

The present invention relates to a steel band 1 for the manufacturing of doctor blades, coater blades or creping blades comprising a steel composition comprising in percent per weight 1-3% C, 4-10% Cr, 1-8% Mo, 2.5-10% V and the remainder essentially iron and contaminants in normal amounts, wherein the steel band 1 is produced by using a powder metallurgical process. Further, this invention relates to doctor blades, coater blades or creping blades of this steel band, as well as a method for its manufacture.

45 Claims, 2 Drawing Sheets

Figure 1:
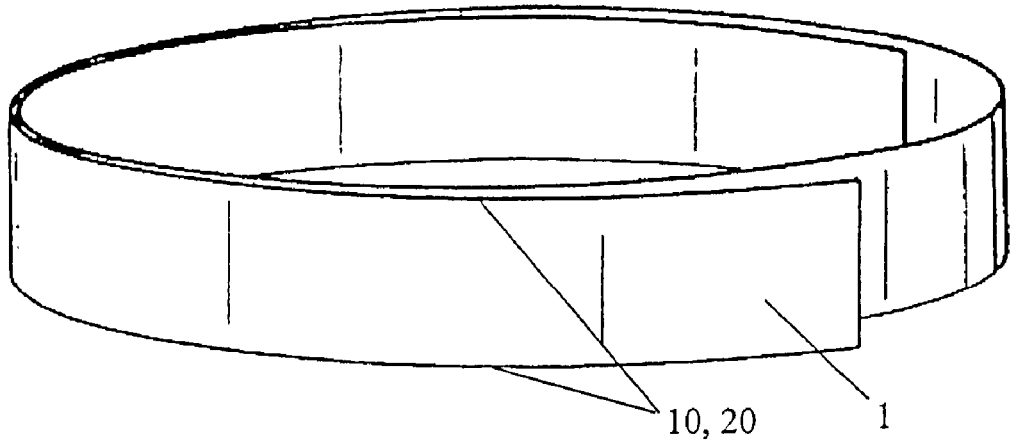

SREADING KNIVES, DOCTOR BLADES AND CREPE SCRAPERS AND POWDER METALLURGICAL METHOD FOR PRODUCING THE SAME

TECHNICAL FIELD

The invention concerns a cold rolled band, having a thickness of 0.05-1.2 mm, which is used as material for the manufacture of coater blades, doctor blades and creping blades.

PRIOR ART

In the paper industry, coater blades or doctor blades in the shape of thin, long blades are used for coating the paper web with a coating slip. These blades are pressed against the moving paper web, usually with back pressure provided by a counter roll, or by a blade, on the opposite side of the paper web, when two-sided coating is performed. To provide even and top quality coating the coater blade must be straight. The normal specification is that the machined edge of the coater blade must not deviate more than 0.3 mm per 3000 mm coater blade length, from complete straightness.

To satisfy this requirement it is be necessary to select a steel alloy that prevents the strips from deforming during hardening and tempering, if the steel strips must undergo these processes. It is a known fact that alloy steels cause more problems in this respect than non-alloy steels, and this is particularly true for steel alloys that contain several different interacting alloying elements. The most common material in coater blades has traditionally been carbon steel. A typical composition of such a steel is for example (in % by weight) 1.00% C, 0.30% Si, 0.40% Mn, 0.15% Cr, and the remainder iron and contaminants in normal proportions. Martensite stainless steel is also used for making coater blades, for example, the steel with the principal composition (in % by weight) 0.38% C, 0.5% Si, 0.55% Mn, 13.5% Cr, 1.0% Mo, and the remainder iron and contaminants in normal proportions.

In the paper industry, creping blades are also used under similar conditions as those described above, in order to obtain a certain amount of creping on a paper. On these creping blades, as well as on those above, high demands are set on the straightness of the working edge.

In the printing industry band-shaped spreading tools, known as scrapers, are also used. They are similar to the coater blades used in the paper industry. These scrapers must also satisfy high requirements in terms of straightness. The same material is used in both scrapers and coater blades.

Coater blades are worn down heavily at their edge by using abrasive pigments in the surface application material, and by the base paper. Doctor blades are also stressed heavily by the color pigment in the application ink, which is applied by the doctor blades. It is thus also desirable that both coater blades and doctor blades have a high abrasion resistance and consequently long life span.

Neither carbon steel nor martensite stainless steel doctor blades do, however, satisfy this condition. Consequently, it is standard practice to replace blades already after a few hours of operation in a paper machine. This is of course a disadvantage, because of the loss of production when replacing the blades.

In EP 0 672 761 B1 a steel is described with a composition comprising (in % by weight) 0.46%-0.70% C, 0.2%-1.5% Si, 0.1%-2.0% Mn, 1.0%-6.0% Cr, 0.5%-5% Mo, 0.5%-1.5% V, max. 0.01% B, max. 1.0% Ni, max. 0.2% Nb, and the remainder iron and contaminants in normal proportions. The steel is suitable for the production of thin, cold rolled bands, and in hardened and tempered condition it can be used for manufacture of doctor and/or coater blades. The cold rolling process comprises a hardening step with austenitization at 1000° C. followed by a tempering step in a lead bath at a temperature between 240° C. to 270° C. Doctor and/or coater blades of this material have good wear resistance and straightness and the life span is 12 to 16 hours.

It is further known that the abrasion resistance of alloyed steel can be higher than the one of non alloyed steel. This is advantageous at particular tool steels and construction steels. Some examples are the alloyed steels described in the JP-A-61/41749 as well as in the U.S. Pat. No. 4,743,426 and in the U.S. Pat. No. 2,565,264, for guiding pins in plastic mould, respectively, hot-worked steels for example for the nozzles for aluminium extrusion at high temperatures as well as for turbine blades, forging tools, cutting tools or similar products and which are made from block or rod material. However steel alloys of this kind are not used for the production of thin, cold rolled, hardened and tempered bands for coater and doctor blades as well as for creping blades, probably since during the cold rolling and the heat treatment of the band, lager problems may occur, which lead to crack forming, deviations from the straightness and similar defects, such that the material is unsuitable for coater and/or doctor blades or creping blades.

An already known method for increasing the life span of the doctor blades is to coat the edges with a ceramic layer. This increases the effective life span considerably. However, these doctor blades are very expensive and are consequently not in widespread use.

In a further different approach, which is described in the WO 02/35002, a bimetal doctor blade is proposed. In this case, the basis band of the coater blade comprises of tough elastic steel onto which an abrasion resistance strip of HSS is applied, to increase the life span the of the doctor blade. These bimetal doctor blades due to their material differences comprise disadvantages with respect to the rigidity in the transition of base band to the edge. Further, such a bimetal coater blade is very costly in production and correspondingly expensive.

To increase the live span of such doctor and coater blades it would be conceivable to increase the content of the carbide building components, for example Molybdenum (Mo), Vanadium (Va), Chromium (Cr) or Tungsten (W). However, these components tend to form large carbides in the steel during the solidification of the melt in the conventional manufacturing processes.

Such large carbides are undesired in doctor and coater blades since during use of the blades the material around the hard carbide crystals has a higher wear-off compared to the carbide crystals itself. Therefore, after a particular time of use the large carbide crystals extend form the surrounding steel at the blades' edge. This can cause scratches in the paper surface or stripes in the coating of the paper. Further, due to said carbide crystals the counter roll, which is usually covered with plastic, can be damaged.

Coater blades and doctor blades initially are hot rolled from a block into a hot band, which is then cold rolled to a steel band having a thickness of 0.05 mm to 1.2 mm and a width of 10 mm to 250 mm. Conventionally produced steel bands with a high carbide content, however, comprise a limited possibility for cold forming. They tend to become brittle such that steel bands after the forming often show cracks, if they are cold formed to the above-mention dimension.

Therefore it is the problem of the present invention to provide a steel band for doctor, coater and creping blades which has an increased live span and which can be cost efficiently produced.

SUMMARY OF THE INVENTION

The above-mentioned problem is solved by a steel band according patent claim 1, coater blades, doctor blades or creping blades according to one of the claims 25 to 26 or by a method for the production thereof according patent claim 28.

In particular, the problem is solved by a steel band for the production of doctor blades, coater blades or creping blades, comprising a steel composition comprising in weight percent:

1-3% C 4-10% Cr 1-8% Mo 2.5-10% V and the remainder essentially iron and contaminants in normal amounts respectively proportions, wherein the steel band is produced by using a powder metallurgical method.

By means of the powder metallurgical production method, a steel of the above composition can be made, which comprises a high carbide content which can, however, be transformed to a steel band for doctor blades, coater blades or creping blades without becoming brittle or generating cracks. In the following, doctor blades, coater blades and creping blades are summarized by the term "blades". Further, a steel band according to the invention comprises very many small carbide crystals, such that the blade made thereof does evenly wear-off at its edge and no scratch formation in the paper or strips formation in the coating of the paper appears. Additionally, blades of the steel band according to the invention comprise a high wear resistance, without using a costly and expensive manufacturing method. The disadvantages in strength which appear at a bimetal doctor blade, cannot appear at the unitary material of the steel band according to the invention.

Preferably, the steel band comprises a thickness of 0.025 to 1.2 mm and/or a width of 10 to 250 mm.

In a preferred embodiment, the steel band is produced by using a cold roll method. Due to the fine granularity of the microstructure, a cold rolling to the above-mentioned dimensions is made possible.

Further components of the steel composition result from the subclaims. In preferred embodiments, the steel composition accumulatively or alternatively comprises the following components in the following fractions of weight:

1.5-3% C;

Traces to a maximum of 1.1% Si, preferably 0.8-1.1% Si and more preferred 1.0% Si;

Traces to a maximum of 1% Mn, preferably 0.4-0.5% Mn;

Not more than contaminants of W;

Instead of Mo 2-16% W;

Not more than trances of Co;

Traces to a maximum of 12% Co;

6-10% Cr, preferably 6.5-8.5% Cr;

1-2% Mo, preferably 1.5% Mo;

4-10% V;

1.0-2.5% C, preferably 1.2-2.3% C;

1% Si, preferably 0.5% Si;

Traces to a maximum of 1% Mn, preferably 0.3% Mn;

4-5% Cr, preferably 4.2% Cr;

4-8% Mo, preferably 6-7% Mo;

6-7% W, preferably 6.4-6.5% W;

2-7% V, preferably 3.0-6.5% V; and/or 7-12% Co, preferably 8-11% Co.

Preferably, the steel band comprises a working edge, which has a hardness of 500 to 600 HV, preferably 575 to 585 HV and/or a straightness of 0.3 mm/3000 mm length of band.

In a further embodiment, the working edge is hardened, preferably laser-beam hardened. This has the advantage, that without using a vacuum environment, a very focused introduction of heat energy into the material is possible.

A coater blade produced of a steel band according to the invention comprises preferably a thickness of 0.25 to 0.64 mm. A doctor blade produced of a steel band according to the invention preferably comprises a thickness of 0.15 to 1.0 mm. A creping blade produced of a steel band according to the invention preferably comprises a thickness of 0.25 to 1.2 mm.

The above-mentioned problem is further solved by a method for the production of coater blades, doctor blades or creping blades, wherein the method comprises the following steps in this sequence:

a) powder metallurgical production of a steel block with a steel composition according to the invention;

b) hot rolling of the steel block to a steel band; and c) cold rolling of the steel band to a band having a thickness of a maximum 1.2 mm.

Preferably, the step of cold rolling is done by means of edge supports.

In a further preferred embodiment after the step of cold rolling, a hardening step is done at a temperate of 950° C. to 1050° C., followed by a tempering step at a temperature of 550° C. to 650° C.

Preferably, the cold rolling, the hardening and the tempering is done in a continuous process.

Further preferred the hardening step comprises a cooling step, wherein the band is cooled down to a temperature of 150 to 250° C. between cooling plates.

Preferably, the working edge of the band is hardened, preferably by means of a laser beam.

SHORT DESCRIPTION OF THE DRAWINGS

Figure 2:
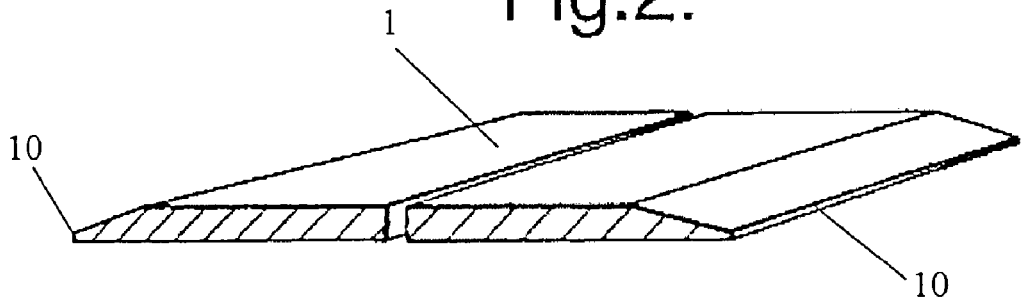
Figure 3:
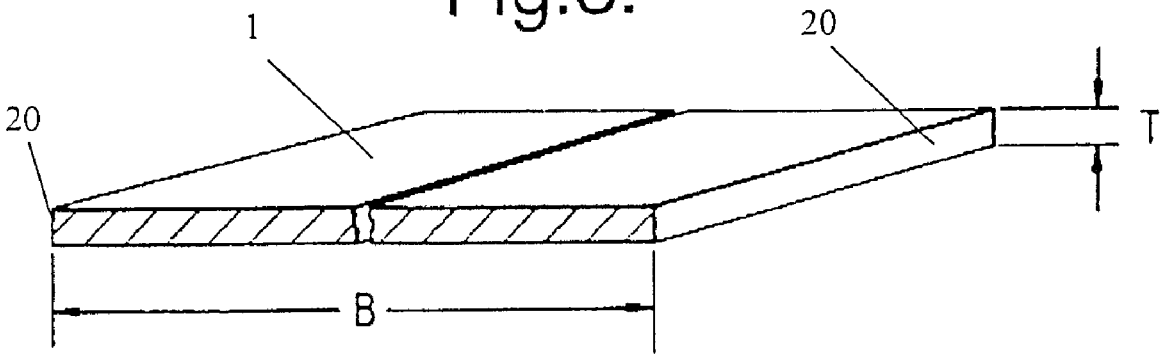
Figure 4:
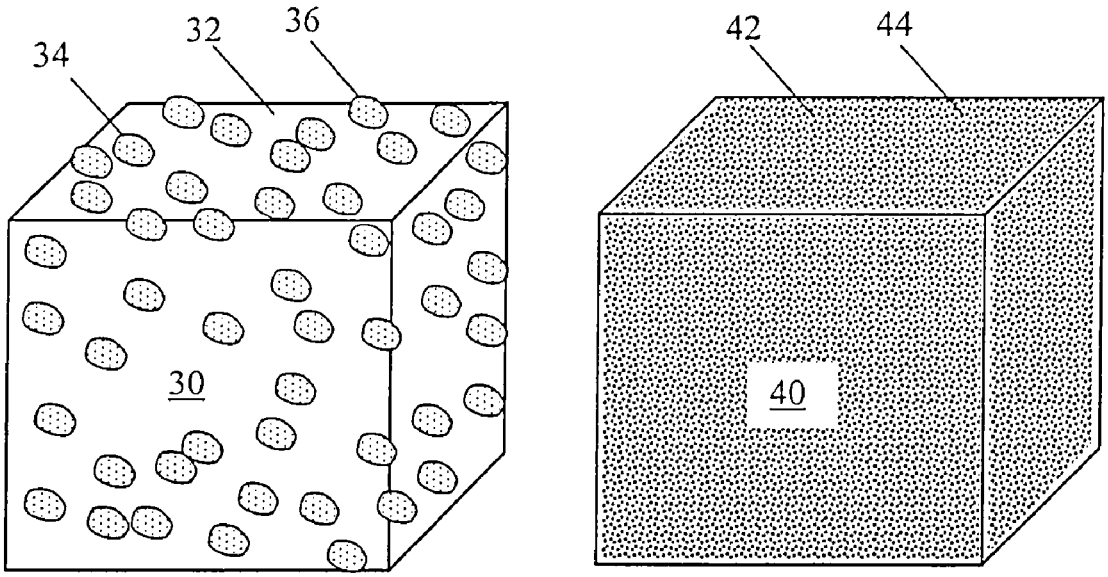
Figure 5:
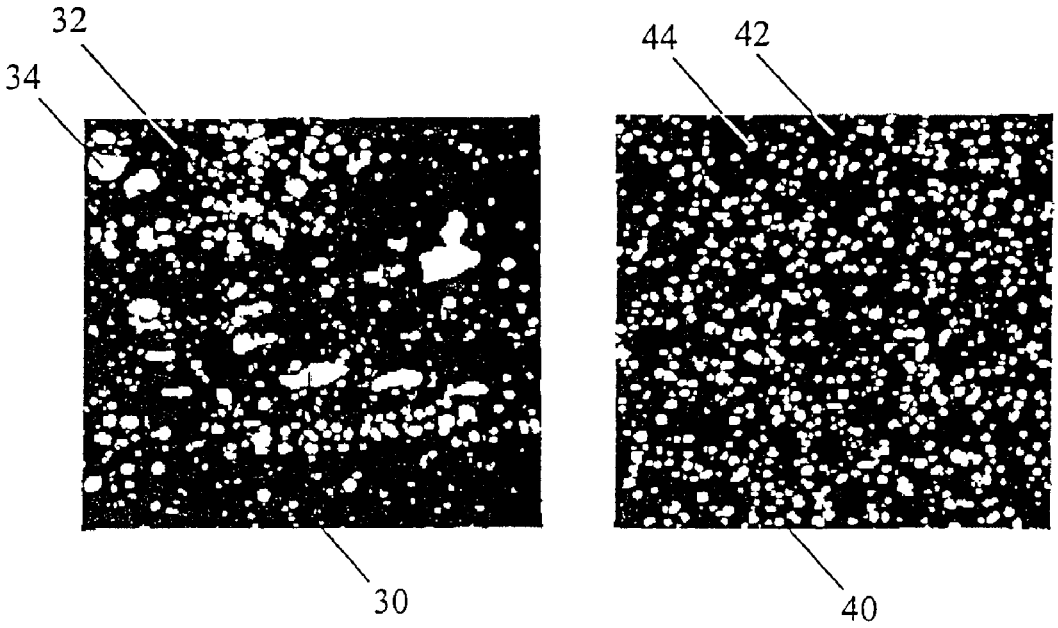

In the following, preferred embodiments are described with reference to the drawings. It shows:

FIG. 1 a three dimensional view of a steel band according to the invention in coiled condition;

FIG. 2 a three dimensional view of a partial sectional view of a steel band according to the invention to clarify a first edge shape;

FIG. 3 a three dimensional partial sectional view of a steel band according to the invention for the clarification of the dimensions and a second edge shape;

FIG. 4 two schematic, three-dimensional microscopic enlarged partial sectional views of the edge material of a steel band, wherein a steel band according the prior art is shown to the left and a steel band according to the invention is shown to the right; and FIG. 5 two microscopic enlarged micrograph section images of the edge material of a steel band, wherein a steel band of the prior art is shown to the left and a steel band according to the invention is shown to the right.

DESCRIPTION OF THE PREFERRED EMBODIMENTS

In the following, preferred embodiments of the present invention are described.

As mentioned above, the invention relates to the use of a particular steel alloy with a particular composition for the production of blades (coater blades and doctor blades, scrapers, creping blades, blades, doctor knives, wipers) in the form of cold rolled, hardened and tempered bands.

FIG. 1 shows a three dimensional view of a steel band 1 according to the invention in coiled condition, as it is provided for shipping. FIG. 3 clarifies the dimensions. Typically, the width B lays between 10 and 250 mm, wherein the thickness of the coater blades lays between 0.05 and 1.2 mm and in a typical case between 0.25 to 0.64 mm. For doctor blades, the thickness lays in a typical case between 0.15 and 1.0 mm, creping blades comprise a typical thickness of 0.25 to 1.2 mm.

As shown in FIG. 3, the worked edge 20 of a blade could either be straight, that means comprises a 90° angle. The edge 10 could, however, also be tapered, as shown in FIG. 2. This is a shape of the edge which is likewise used for coater blades and also for doctor blades.

The content of the different alloy elements and their significance for the steel for this particular field of use is explained in detail in the following.

$1^{st}$ Embodiment

According to a first embodiment of the invention, carbon should exist in sufficient amounts in the steel to give it a basic hardness, sufficient to endure being pressed against the paper web or ink application roll, respectively, without suffering permanent deformation, and to form MC carbides during tempering. The MC carbides provide precipitation hardening and thus improved abrasion resistance. The carbon content should therefore be at least 1.0%, preferably 1.5%. The maximum carbon content is 3%.

Vanadium should exist in the steel to form very small MC carbides during tempering, through precipitation. These MC carbides are thought to be the major reason for the surprisingly good abrasion resistance of the doctor blades according to the invention. The carbides are of a submicroscopic scale, which means a maximum size of the order of magnitude between 1-3 μm. To provide a sufficiently high volume fraction of MC carbides, the vanadium content should be at least 4% V. The vanadium content should not exceed 10% V.

The Chromium content should be at least 6% Cr, preferably at least 6.5% Cr, to give the steel sufficient hardenability, i.e., transform it into martensite during air quenching or after austenitizing. However, chromium is also carbide forming, which makes it compete with vanadium for the carbon in the steel matrix. The higher the chromium content, the less stable are the vanadium carbides. The chromium carbides, however, do not provide the precipitation hardening that is desirable and which can be formed by the vanadium in the above mentioned amounts. Chromium in higher amounts also generates an increased risk for retained austenite. Thus, the chromium content in the steel is limited to 10%, preferably at most 8.5.

The Molybdenum content should be at least 1%, so that it jointly with vanadium can be a part of the MC carbides and in a positive way contribute to the formation of these carbides. Since there is molybdenum in the MC carbides, these dissolve more easily during austenitizing when hardening occurs and are then a part of the MC carbides formed during the tempering. Molybdenum content may, however, be not so high as to form detrimental amounts of molybdenum carbides, which are instable, just like chromium carbides, and grow at high temperatures. The molybdenum content should therefore be limited to 2%, preferably about 1.5%.

Molybdenum can, in the usual fashion, be replaced, completely or partially, by the double amount of tungsten. In the preferred embodiment the alloy composition should therefore not contain tungsten, more than contaminant levels.

The Manganese content in the steel is limited to 1% and contributes, just like chromium, to give the steel the desired hardenability. Preferably the content of manganese is 0.4-0.5% Mn.

The Silicon content should be at least 0.8% to increase the carbon activity in steel and speed up the precipitation of the small vanadium carbides during tempering. The increased carbon activity can, however, also lead to a faster coarsening of the carbides, resulting in a quicker softening of the steel. In other words, the tempering curve is moved to the left and the hardness maximum is moved upwards, when silicon content is high. The steel should, however, not contain more than at most 1.1% silicon and preferably at most 1.0% silicon.

Nickel does not provide any positive contributions to the steel in the intended application area. Possibly, nickel can complicate the heat treatment of the steel. Therefore, it is best if the steel does not contain more nickel than contaminant levels.

Otherwise, the steel contains essentially nothing but iron. Other elements, including for example aluminum, nitrogen, copper, cobalt, titanium, niobium, sulphur and phosphorus, only exist in contaminant levels or as unavoidable accessory elements in the steel.

In this first embodiment of the invention, three different steel alloys have been powder metallurgically produced, cold rolled and tested with good results. These three alloys have been cold rolled to form thin strips, with a thickness of 0.05-1.2 mm and a width between 10-250 mm and can be used for the manufacturing of coater blades, doctor blades and creping blades. The nominal compositions of these steel alloys were as follows:

1.5% C, 1% Si, 0.4% Mn, 8% Cr, 1.5% Mo, 4% V and the remainder iron and unavoidable contaminants, 2.1% C, 1% Si, 0.4% Mn, 6.8% Cr, 1.5% Mo, 5.4% V and the remainder iron and unavoidable contaminants.

2.9% C, 1% Si, 0.5% Mn, 8% Cr, 1.5% Mo, 9.8% V and the remainder iron and unavoidable contaminants.

$2^{nd}$ Embodiment

According to a second embodiment of the invention, carbon should exist in sufficient amounts in the steel to give it a basic hardness, sufficient to endure being pressed against the paper web or ink application roll, respectively, without suffering permanent deformation, and to form MC carbides during tempering. The MC carbides provide precipitation hardening and thus improved abrasion resistance. The carbon content should therefore be at least 1.0% C, preferably 1.2% C. The maximum carbon content is 2.5% C, preferably at most 2.3% C.

Vanadium should exist in the steel to form very small MC carbides during tempering, through precipitation. These MC carbides are thought to be the major reason for the surprisingly good abrasion resistance of the doctor blades. The carbides are of a submicroscopic scale, which means a maximum size of the order of magnitude of 1-3 μm. To provide a sufficiently high volume fraction of MC carbides, the vanadium content should be at least 2.5% V, preferably at least 3.0% V. The vanadium content should not exceed 7% V, and preferably the steel contains at most 6.5% vanadium.

In this embodiment the amount of chromium is delimited. In order to give the steel sufficient hardenability, i.e., transform it into martensite during air quenching or after austenitizing, the chromium content should be at least 4% Cr. However, chromium is also carbide forming, which makes it compete with vanadium for the carbon in the steel matrix. The higher the chromium content, the less stable are the vanadium carbides. The chromium content in the steel can amount to 5%. The nominal content is about 4.2%.

The molybdenum content should be at least 4%, so that it jointly with vanadium can form the MC carbides and in a positive way contribute to the formation of these carbides. Since there is molybdenum in the MC carbides, these dissolve more easily during austenitizing when hardening occurs and are then a part of the MC carbides formed during the tempering. The Molybdenum content may, however, not be so high as to form detrimental amounts of molybdenum carbides, which are instable, just like chromium carbides, and grow at high temperatures. According to this second embodiment of the invention, the molybdenum content should be limited to 8% Mo, and preferably between 5-7% Mo.

Molybdenum can, in the usual fashion, be replaced, completely or partially, by the double amount of tungsten. Tungsten improves the wear resistance, raise the hardening temperature and improves the heat resistance. According to this second embodiment of the invention, the steel contains 6-7% W, suitably about 6.4-6.5% tungsten.

The manganese content in the steel is limited to 1% and contributes, just like chromium, to give the steel the desired hardenability. Preferably the content of manganese is 0.3% Mn.

The silicon content should be at least 0.8% to increase the carbon activity in steel and speed up the precipitation of the small vanadium carbides during tempering. The increased carbon activity can, however, also lead to a faster coarsening of the carbides, resulting in a quicker softening of the steel. In other words, the tempering curve is moved to the left and the hardness maximum is moved upwards, when silicon content is high. The steel should, however, not contain more than at most 0.8% silicon and preferably at most 0.5% silicon.

Nickel does not provide any positive contributions to the steel in the intended application area. Possibly, nickel can complicate the heat treatment of the steel. Therefor, according to the second embodiment of the invention, it is best if the steel does not contain more nickel than contaminant levels.

According to the second embodiment of the present invention, the steel contains cobalt in an amount of at least 8%. Cobalt improves the hot workability of the steel. However, cobalt also makes the steel more brittle and raises the deformation hardening in cold work operations. Thus, the steel should not contain more than 12% cobalt, preferably not more than 11%. An improved hot workability is no critical property of the steel, and therefore the steel according to this second embodiment essentially does not contain any cobalt.

Otherwise, the steel contains essentially nothing but iron. Other elements, including for example aluminum, nitrogen, copper, cobalt, titanium, niobium, sulphur and phosphorus, only exist in contaminant levels or as unavoidable accessory elements in the steel.

In this second embodiment of the invention, three different steel alloys have been made with a powder-metallurgical method, cold rolled and tested with good results. The three alloys have been cold rolled to form thin strips, with a thickness of 0.05-1.2 mm and a width between 10-250 mm and can be used for the manufacturing of blades. The nominal compositions of these steel alloys were as follows:

1.28% C, 0.5% Si, 0.3% Mn, 4.2% Cr, 5% Mo, 6.4% W, 3.1% V and the remainder iron and unavoidable contaminants.

1.28% C, 0.5% Si, 0.3% Mn, 4.2% Cr, 5% Mo, 6.4% W, 5.4% V, 8.5% Co and the remainder iron and unavoidable contaminants.

2.3% C, 0.5% Si, 0.3% Mn, 4.2% Cr, 7% Mo, 6.5% W, 6.5% V, 10.5% Co and the remainder iron and unavoidable contaminants.

The manufacturing of coater blades, doctor blades or creping blades, according to the present invention, will be done as follows. An alloy containing the desired composition, described above and in the patent claims, is produced using powder metallurgical processing. Thereby, the powder is mixed to the desired composition and is compacted to solid blanks or blocks by means of hot isostatic pressing. The blanks (respectively blocks) are hot-rolled into strips of an approximate thickness of 3-3.5 mm. Then, these strips are cold-rolled to a desired thickness of less than 1.2 mm, alternating with reheating operations. In order to avoid edge cracks in the strips 1, the cold rolling operation takes place with the use of edge supports at the thickness reduction from approximately 3.5 mm down to 1 mm. The cold rolled strip 1 is then hardened and tempered in a continuous process, when the strip has reached its final thickness T in the cold rolling.

The cold-rolled strips 1 of the first embodiment will be hardened using austenitizing at a temperature between 950° C.-1050° C., followed by quenching between cooling plates down to a temperature between 150° C.-250° C., and tempering at 550° C.-650° C.

The cold-rolled strips 1 of the second embodiment will be hardened using austenitizing at a temperature between 1000° C.-1050° C., followed by quenching between cooling plates down to a temperature between 150° C.-250° C., and tempering at 550° C.-650° C.

This is followed by brushing of the surfaces of the strips 1. If desired, the strips 1 can be colored by tempering in an oxidizing atmosphere. The strips 1 are cut to correct length and width B, and the edge 10, 20 is machined through planing and/or grinding to obtain the desired edge profile.

Thanks to the method according the invention, cold rolled strips with widths up to 250 mm can be manufactured without waive to, primarily, sufficient straightness of the working edge. But the flatness of the strip is of significant importance as well. The working edge should have a straightness of 0.3 mm/3000 mm length of the band. The flatness should be at least 0.3% of nominal strip width, according to the standard Pilhöjd.

Furthermore, the strips are characterized in that the working edges 10, 20 show improved properties, especially improved wear resistance, in comparison to other strips available for these applications today.

According to an alternative embodiment the working edge 10, 20 may be hardened using local heating of the edge section, for example by induction heating. Preferably, high energy beam hardening is used, for example laser, plasma or electron beam hardening, which gives the working edge 10, 20 a distinct hardened section that doesn't impair the straightness of the strip. To this end, preferably, a laser beam is used. The working edge 10, 20, hardened in this manner, will obtain an improved hardness of up to 630 HV, preferably 620 HV.

Further, the working edge 10, 20 of a steel band according to the invention due to the powder metallurgical production process comprises a particularly fine microstructure. In FIGS. 4 and 5 microscopic sectional enlargements of the microstructure of the working edge 10, 20 is shown. The left image in FIGS. 4 and 5 shows a microstructure 30 according the prior art, which is made by a usual melting process. Schematically large hard carbides 34, 36 are shown, which are embedded into a surrounding alloy 32. After a particular time of use, the working edge 10, 20 wears off, wherein the carbides 34, 36 wear off less heavy than the surrounding materials 32. Thereby, the carbides at the surface extend from the remainder microstructure, as it is shown at carbide having the reference no. 36. Such extending carbides generate scratches on the on the paper surface or on the counter roll or stripes in the coating of the paper, such that the blades have to be exchanged.

At the right side of FIGS. 4 and 5, a microstructure 40 of a working edge 10, 20 according to the invention is shown. The microstructure 40 comprises the same steel composition as the microstructure 30, however, it is produced by means of a powder metallurgical process. Thereby, fine, well dispersed carbides 44 are produced, which are embedded within a surrounding microstructure 42. A working edge 10, 20 with such a microstructure 40 wears off evenly and without extending carbides 36 and therefore does not lead to a generation of scratches or stripes.

The method according to the invention which allows to successfully produce cold rolled bands with width up to 250 mm makes it possible that a plurality of small stripes are made simultaneously. In this case, a wide stripe 1 is cut into small stripes, prior to a working of the edges 10, 20. In that way, for example, two narrow bands can be obtained by means of a single cold rolling process from one wide band.

The invention claimed is:

1. Doctor blades, coater blades or creping blades comprising a steel band, said steel band having a steel composition comprising in percent per weight 1-3% C
4-10% Cr
1-8% Mo
2.5-10% V
and optionally from traces to a maximum of 1.1% Si and/or from traces to a maximum of 1% Mn and/or 2%-16% W instead of Mo and/or traces to a maximum of 12% Go, and the remainder iron and contaminants in normal amounts, wherein the steel band is produced by using a powder metallurgical process; has a thickness of 0.05-1.2 mm; is produced by using a cold roll process; and has a working edge having a straightness of less than 0.3 mm/3000 mm length.

2. Doctor blade, coater blade or creping blade according claim 1, wherein the steel band has a width of 10-250 mm.

3. Doctor blade, coater blade or creping blade according to claim 1, wherein the steel composition comprises 1.5-3% C.

4. Doctor blade, coater blade or creping blade according to claim 1, wherein the steel composition comprises 0.8-1.1% Si.

5. Doctor blade, coater blade or creping blade according to claim 1, wherein the steel composition comprises 0.4-0.5% Mn.

6. Doctor blade, coater blade or creping blade according to claim 1, wherein the steel composition comprises no more than a contaminant level of W.

7. Doctor blade, coater blade or creping blade according to claim 1, wherein the steel composition comprises no more than a contaminant level of Co.

8. Doctor blade, coater blade or creping blade according to claim 1, wherein the steel composition comprises 6-10% Cr.

9. Doctor blade, coater blade or creping blade according to claim 1, wherein the steel composition comprises 1-2% Mo.

10. Doctor blade, coater blade or creping blade according to claim 1, wherein the steel composition comprises 4-10% V.

11. Doctor blade, coater blade or creping blade according to claim 1, wherein the steel composition comprises 1.0-2.5% C.

12. Doctor blade, coater blade or creping blade according to claim 11, wherein the steel composition further comprises from traces to a maximum of 1% Si.

13. Doctor blade, coater blade or creping blade according to claim 11, wherein the steel composition further comprises from traces to a maximum of 1% Mn.

14. Doctor blade, coater blade or creping blade according to claim 11, wherein the steel composition comprises 4-5% Cr.

15. Doctor blade, coater blade or creping blade according to claim 11, wherein the steel composition comprises 4-8% Mo.

16. Doctor blade, coater blade or creping blade according to claim 11, wherein the steel composition comprises 6-7% W.

17. Doctor blade, coater blade or creping blade according to claim 11, wherein the steel composition comprises 2.5-7% V.

18. Doctor blade, coater blade or creping blade according to claim 11, wherein the steel composition comprises no more than a contaminant level of Co.

19. Doctor blade, coater blade or creping blade according to claim 11, wherein the steel composition further comprises 7-12% Co.

20. Doctor blade, coater blade or creping blade according to claim 1, wherein the working edge has a hardness of 500-600 HV.

21. Doctor blade, coater blade or creping blade according to claim 1, wherein the working edge is hardened.

22. Coater blade according to claim 1, wherein the coater blade has a thickness of 0.25-0.64 mm.

23. Doctor blade according to claim 1, wherein the doctor blade comprises a thickness of 0.15-1.0 mm.

24. Creping blade according to claim 1, wherein the creping blade has a thickness of 0.25-1.2 mm.

25. Method for the manufacturing of coater blades, doctor blades or creping blades according to claim 1, wherein the method comprises the following steps in the following sequence:

a) powder metallurgical production of a steel block with a steel composition according to claim 1;
b) hot rolling of the steel block to a steel band; and
c) cold rolling of the steel band to a band with a thickness of maximum 1.2 mm.

26. Method according claim 25, wherein the step of cold rolling takes place with the use of edge supports.

27. Method according to claim 25, wherein after the step of the cold rolling a hardening step is performed at a temperature of 950° C.-1050° C., followed by a tempering step at a temperature of 550° C.-650° C.

28. Method according claim 27, wherein the cold rolling, the hardening and the tempering is performed in a continuous process.

29. Method according to claim 27, wherein the hardening step comprises a cooling step, wherein the band is cooled down between cooling plates to a temperature of 150° C.-250° C.

30. Method according to claim 25, wherein after the step of cold rolling, a hardening step is performed on the working edge of the band.

31. Doctor blade, coater blade or creping blade according to claim 4, wherein the steel composition comprises 1.0% Si.

32. Doctor blade, coater blade or creping blade according to claim 8, wherein the steel composition comprises 6.5-8.5% Cr.

33. Doctor blade, coater blade or creping blade according to claim 9, wherein the steel composition comprises 1.5% Mo.

34. Doctor blade, coater blade or creping blade according to claim 11, wherein the steel composition comprises 1.2-2.3% C.

35. Doctor blade, coater blade or creping blade according to claim 12, wherein the steel composition comprises from traces to a maximum of 0.5% Si.

36. Doctor blade, coater blade or creping blade according to claim 13, wherein the steel composition comprises from traces to a maximum of 0.3% Mn.

37. Doctor blade, coater blade or creping blade according to claim 14, wherein the steel composition comprises 4.2% Cr.

38. Doctor blade, coater blade or creping blade according to claim 15, wherein the steel composition comprises 6-7% Mo.

39. Doctor blade, coater blade or creping blade according to claim 16, wherein the steel composition comprises 6.4-6.5% W.

40. Doctor blade, coater blade or creping blade according to claim 17, wherein the steel composition comprises 3.0-6.5% V.

41. Doctor blade, coater blade or creping blade according to claim 19, wherein the steel composition comprises 8-11% Co.

42. Doctor blade, coater blade or creping blade according to claim 20, comprising a working edge, which has a hardness of 575-585 HV.

43. Doctor blade, coater blade or creping blade according to claim 21, wherein the working edge is laser-beam hardened.

44. Method according to claim 30, wherein a laser-beam hardening is performed on the working edge of the band.

45. Doctor blades, coater blades or creping blades comprising a steel band, said steel band having a steel composition comprising in percent per weight 1-3% C
4-10% Cr
1-8% Mo
2.5-10% V
and optionally from traces to a maximum of 1.1% Si and/or from traces to a maximum of 1% Mn and/or 2%-16% W instead of Mo and/or traces to a maximum of 12% Go, and the remainder iron and contaminants in normal amounts, wherein the steel band is produced by using a powder metallurgical process; has a thickness of 0.05-1.2 mm; is produced by using a cold roll process; has a working edge having a straightness of less than 0.3 mm/3000 mm length; wherein the working edge is hardened and has a hardness of 500-600 HV.

* * * * *